US010322419B2

(12) United States Patent
Eberle et al.

(10) Patent No.: US 10,322,419 B2
(45) Date of Patent: Jun. 18, 2019

(54) DUAL CENTRIFUGE ROTOR WITH DAMPING MASS

(71) Applicant: ANDREAS HETTICH GMBH & CO. KG, Tuttlingen (DE)

(72) Inventors: Klaus-Guenter Eberle, Tuttlingen (DE); Ulrich Massing, Merzhausen (DE); Jovan Dobos, Tuttlingen (DE); Vittorio Ziroli, March (DE)

(73) Assignee: ANDREAS HETTICH GMBH & CO. KG, Tuttlingen (DE)

( * ) Notice: Subject to any disclaimer, the term of this patent is extended or adjusted under 35 U.S.C. 154(b) by 0 days.

(21) Appl. No.: 15/543,999

(22) PCT Filed: Nov. 24, 2015

(86) PCT No.: PCT/EP2015/077540
§ 371 (c)(1),
(2) Date: Jul. 15, 2017

(87) PCT Pub. No.: WO2016/113023
PCT Pub. Date: Jul. 21, 2016

(65) Prior Publication Data

US 2018/0036744 A1 Feb. 8, 2018

(30) Foreign Application Priority Data

Jan. 16, 2015 (DE) ..... 10 2015 100 613

(51) Int. Cl.
*B04B 5/02* (2006.01)
*B01F 9/00* (2006.01)
(Continued)

(52) U.S. Cl.
CPC ..... *B04B 5/02* (2013.01); *B01F 9/0001* (2013.01); *B01F 9/0003* (2013.01);
(Continued)

(58) Field of Classification Search
CPC ..... B01F 15/00896; B01F 15/00746; B01F 9/0001; B01F 15/00824; B01F 15/00831;
(Continued)

(56) References Cited

U.S. PATENT DOCUMENTS 1,011,929 A * 12/1911 Ecaubert ..... B04B 1/00 366/213
3,199,775 A * 8/1965 Drucker ..... B04B 5/02 366/217
(Continued)

FOREIGN PATENT DOCUMENTS

CN 1812842 8/2006
CN 203519617 4/2014
(Continued)

OTHER PUBLICATIONS

The International Bureau of WIPO, Translation of PCT International Preliminary Report on Patentability, dated Jul. 27, 2017, pp. 1-10,International Application No. PCT/EP2015/077540, Applicant: Andreas Hettich GMBH & Co. KG.
(Continued)

*Primary Examiner* — Charles Cooley
(74) *Attorney, Agent, or Firm* — Woodling, Krost and Rust

(57) ABSTRACT

A rotor (10) of a dual centrifuge which can be rotated about a drive axis (A) in a centrifuge, which rotor comprises at least two rotary units (26) that are arranged symmetrically to one another and have a bearing (32) and a rotary head (30) which is connected to the bearing (32) and which is mounted in the bearing (32) so as to be rotatable about a rotational axis (R1, R2), which rotary head (30) can be driven about the rotational axis (R1, R2) relative to the rotor by another rotary mechanism (46) of the centrifuge and has a rotary head receiving unit (80) for at least one sample container or at least one sample container receptacle (100, 110), with the
(Continued)

rotational axis (R1, R2) of the rotary head (30) being inclined relative to the drive axis (A) of the rotor, the rotary head receiving unit (80) being designed to receive an elongated sample container receptacle (100, 110) or an elongated sample container, and the longitudinal axis of the sample container receptacle (100, 110) introduced into the rotary head receiving unit (80) or the longitudinal axis of the sample container introduced into the rotary head receiving unit (80) extending perpendicular to the axis of rotation (R1, R2) of the rotary head (30) or being oriented at an angle ranging between more than 0° and less than 90° relative to the axis of rotation. At least one connection region (52) is provided to which at least one damping mass (54) can be selectively attached either in a releasable manner or, by a fixing element, in a permanent manner for operation.

20 Claims, 5 Drawing Sheets

(51) Int. Cl.

| | |
|---|---|
| ***B04B 9/14*** | (2006.01) |
| ***B01F 15/00*** | (2006.01) |
| ***B02C 17/08*** | (2006.01) |
| ***B04B 9/12*** | (2006.01) |

(52) U.S. Cl.
CPC ..... *B01F 15/00824* (2013.01); *B02C 17/08* (2013.01); *B04B 9/12* (2013.01); *B04B 9/14* (2013.01); *B01F 2009/0067* (2013.01); *B01F 2015/0011* (2013.01); *B01F 2015/00642* (2013.01)

(58) Field of Classification Search
CPC ..... B01F 9/0003; B01F 9/0021; B01F 2009/0067; B01F 2015/0011; B01F 2015/00642; A23G 9/086; A23G 9/106; A23G 9/22; A23G 9/08; A23G 9/224; G05B 15/02; A23V 2002/00; B04B 5/02; B04B 9/14; B04B 9/12; B02C 17/08
USPC ..... 366/209–219; 494/19; 433/49, 90, 91
See application file for complete search history.

(56) References Cited

U.S. PATENT DOCUMENTS

| | | | | | |
|---|---|---|---|---|---|
| 4,497,581 | A * | 2/1985 | Miller | B01F 9/0001 | 366/208 |
| 5,167,448 | A * | 12/1992 | Herold | B01F 9/0001 | 366/213 |
| 5,352,037 | A * | 10/1994 | Jouvin | B01F 9/0001 | 366/219 |
| 5,551,779 | A * | 9/1996 | Gantner | B01F 9/0001 | 366/217 |
| 5,746,510 | A * | 5/1998 | Mark | B01F 9/0001 | 366/217 |
| 7,285,085 | B2 | 10/2007 | Kim et al. | | |
| 8,303,989 | B2 | 11/2012 | Choi et al. | | |
| 8,932,417 | B1 * | 1/2015 | Renz | C06B 21/0025 | 149/109.2 |
| 9,802,208 | B2 | 10/2017 | Tsai et al. | | |
| 2008/0192564 | A1 * | 8/2008 | Jouvin | A61K 6/10 | 366/7 |
| 2008/0193511 | A1 | 8/2008 | Massing | | |
| 2015/0110735 | A1 * | 4/2015 | Hoffman | B01F 9/0001 | 424/85.2 |
| 2015/0174539 | A1 * | 6/2015 | Eberle | B01F 9/0001 | 366/218 |
| 2017/0296990 | A1 * | 10/2017 | Hoffman | B01F 9/0001 | |
| 2017/0348653 | A1 * | 12/2017 | Dobos | B01F 9/0001 | |
| 2017/0348704 | A1 * | 12/2017 | Dobos | B04B 5/0414 | |
| 2018/0036694 | A1 * | 2/2018 | Lenz | B01F 9/0001 | |
| 2018/0036744 | A1 * | 2/2018 | Eberle | B02C 17/08 | |
| 2018/0304175 | A1 * | 10/2018 | Takaoka | B01D 19/00 | |

FOREIGN PATENT DOCUMENTS

| | | | | |
|---|---|---|---|---|
| DE | 102012105819 | | 4/2014 | |
| EP | 0402668 | | 12/1990 | |
| EP | 2263653 | | 12/2010 | |
| EP | 2263654 | | 12/2010 | |
| FR | 2955042 | | 1/2010 | |
| JP | 2010194470 | | 9/2010 | |
| WO | WO-2016107704 | A1 * | 7/2016 | B01F 9/0001 |

OTHER PUBLICATIONS

European Patent Office, International Search Report, dated Jul. 21, 2016, pp. 1-4, International Application No. PCT/EP2015/077540, Applicant: Andreas Hettich GMBH & Co. KG.

European Patent Office, Written Opinion of the International Search Report, dated Jul. 21, 2016, pp. 1-7, International Application No. PCT/EP2015/077540.

German Patent Office, German Search Report, dated Oct. 12, 2015, pp. 1-9, Application No. 102015100613.8, Applicant: Andreas Hettich GMBH & Co. KG.

The State Intellectual Property Office of China, Notification of the First Office Action, Office Action, dated Sep. 26, 2018, pp. 1-26, Application No. 201580073700.6, Applicant: Andreas Hettich GMBH & Co. KG.

The State Intellectual Property Office of China, Translation of the Notification of the First Office Action, Office Action, dated Sep. 26, 2018, pp. 1-9, Application No. 201580073700.6, Applicant: Andreas Hettich GMBH & Co. KG.

* cited by examiner

DUAL CENTRIFUGE ROTOR WITH DAMPING MASS

CROSS-REFERENCES TO RELATED APPLICATIONS

This patent application is the national phase entry of PCT/EP2015/077540, international application filing date Nov. 24, 2015, which claims the benefit and priority of and to German patent application no. 10 2015 100 613.8, filed Jan. 16, 2015.

PCT/EP2015/077540, international application filing date Nov. 24, 2015 and German patent application no. 10 2015 100 613.8, filed Jan. 16, 2015 are incorporated herein by reference hereto in their entireties.

FIELD OF THE INVENTION

The invention relates to a dual centrifuge rotor.

DESCRIPTION OF THE RELATED ART

EP 2 263 654 A2 discloses a method for producing lipid-based nanoparticles as well as to kits and accessories for producing the lipid-based nanoparticles by way of homogenization in a dual asymmetric centrifuge. As may be gathered from this printed publication, better results are achieved if the longitudinal axis of a sample container containing the materials for producing the lipid-based nanoparticles is arranged at an angle, preferably an angle ranging from 70° to 110°, to an axis of rotation of a rotary unit. Frequently, the dual centrifuge includes two or plural rotary units so as to enable the centrifuge to accommodate a higher number of sample containers and thus process a higher number of samples simultaneously. The homogenization of materials, as well as the mixing or grinding of samples, in sample containers which preferably have their longitudinal axis aligned at an angle of between 70° and 110°, relative to the axis of rotation of a rotary unit, is effected by the rapid movement of the materials in the sample containers, as a function of the respective position of the containers relative to the centrifugal force of the dual centrifuge. These rapid movements of material in the containers will result in uneven loads, and thus imbalances, in the dual centrifuge.

The high rotary speeds required for numerous homogenization, mixing or grinding processes then result in correspondingly large mass imbalances. The orientation of the sample containers may be a major cause for imbalances in the rotor. If the longitudinal axis of the sample container is not aligned concentrically with or parallel to the axis of rotation of the rotary unit, there will be a higher risk of imbalances occurring in the rotor. On the other hand, an asynchronous arrangement of the sample containers in the individual rotary units will increase the adverse effect of the mass imbalances since the mass movements in the sample containers cannot possibly be synchronous.

These imbalances which are required for the process not only result in noise and disruptive vibrations but also lead to premature wear and tear of mechanical components—which adversely affects the safety of the centrifuge and results in unnecessary costs. Moreover, the quality of the sample material to be produced is also compromised by the presence of imbalances in excess of the extent necessary. For this reason, the required process imbalances will have to be reduced, or compensated, to the required extent.

EP 2 263 653 A2 and FR 2 955 042 A1 each disclose asymmetric centrifuges. In these cases, masses are inserted in the rotor for balancing the asymmetric loads. However, the subject matter of the present application is a symmetric centrifuge, so the present invention aims at solving a different kind of problem.

SUMMARY OF THE INVENTION

It is the object of the invention to provide a rotor of a dual centrifuge which avoids the abovementioned shortcomings and in which the required mass shifts for the process and the resulting imbalances in the sample containers do occur, in which the imbalances of the overall rotor unit do not exceed a technically acceptable extent, however.

The invention is based on the finding that the overall mass of the rotor can be increased by using additional damping masses and/or by aligning the sample container receptacle and hence the sample containers in an identical manner relative to the rotor and thus synchronizing the movement of the at least two rotary units present as optimally as possible.

As a matter of fact, these findings do not relate exclusively to the production of lipid-based nanoparticles, but generally to rotors used in dual centrifuges. Some important processes here are the grinding and/or the mixing of samples, for example.

According to the invention, a dual centrifuge rotor which is adapted to rotate about a main axis of the centrifuge comprises at least two rotary units that are arranged symmetrically to one another and each have a bearing and a rotary head which is connected to the bearing and which is mounted in the bearing so as to be rotatable about an axis of rotation. The rotary heads can be driven to rotate about the axis of rotation relative to the rotor by another rotary mechanism of the centrifuge, and have a rotary head receiving unit for at least one sample container and/or at least one sample container receptacle. The axis of rotation of the rotary unit of the rotor is inclined relative to the drive axis of the rotor. The rotary head receiving unit is designed to receive an elongated sample container receptacle and/or an elongated sample container. The longitudinal axis of the sample container receptacle introduced into the rotary head receiving unit or the longitudinal axis of the sample container introduced into the rotary head receiving unit is oriented perpendicular to the axis of rotation of the rotary head or at an angle between more than 0° and less than 90° relative to the axis of rotation. At least one connection region is provided on the rotor to which at least one damping mass can be selectively attached either in a releasable manner or, by means of a fixing element, in a permanent manner for operation. This allows one or plural suitable damping masses to be chosen and attached as required. This makes it possible to minimize the adverse effects of imbalances occurring in operation of the overall dual centrifuge. This in turn results in improved operational safety and a longer service life of the centrifuge.

In accordance with an advantageous further development of the invention, the main axis of the dual centrifuge and the axis of rotation of the rotary unit intersect, defining a plane between them in which the axis of rotation intersects the main axis at an angle which is more than 0° and less than 90°.

In one embodiment, two equally designed rotary units are provided in a rotor for a dual centrifuge, which units are identically aligned relative to the main axis at a zero position. All the rotary head receiving units, preferably with the sample container receptacles and/or the sample containers, are arranged in an identical manner in the rotary units and the rotary units move synchronously in operation. In this case, the drive axis—main axis—of the centrifuge is the mirror axis of the rotary units. The identical arrangement of the rotary head receiving units, in particular with the sample container receptacles and/or the sample containers, and the synchronous movements of the rotary units prevents the occurrence of imbalances throughout the entire centrifuge. In this case it is advantageous if at least one connection region is also provided on the rotor which region can be used for selectively attaching at least one damping mass thereto either in a releasable manner or, by means of a fixing element, in a permanent manner for operation.

It is advantageous if at least one damping mass is provided on the rotor in the connection region. This considerably reduces the adverse effect of the system's inherent imbalance on the overall system.

If the damping mass of a connection region consists of plural mass elements, the imbalance can be counteracted in even more specific manner. In other words, it is possible to create an optimum solution with an as high as possible damping mass for compensating the imbalances and the overall mass of the rotor which latter, however, should not be too high in view of the required rotor acceleration and the existing motor mount. In the case of lower rotor weights, the safety vessel of the centrifuge can be of a weaker design, for example.

In one aspect of the invention, a set of mass elements of different weights is provided, which mass elements are used to create a damping mass of a predetermined weight or a plurality of damping masses of predetermined weights which are either identical and/or non-identical, as required. This allows a particularly specific selection of the damping mass for the most varied requirements such as non-uniform loading of the centrifuge with samples or varying size of the mass moved by the rotary head receiving unit with the sample container receptacle and/or the sample container(s).

Instead of compiling the damping mass from different mass elements as required, it is also possible to provide a set of damping masses of different and/or identical weights right from the start. As required, a single damping mass will be introduced into the connection region or plural damping masses will be introduced into connection regions. This will enable the centrifuge operator to quickly select and attach the suitable damping mass required for the respective application.

In another advantageous embodiment, at least one sample container receptacle or sample container can be mounted in the rotary head receiving unit, and the damping masses are determined as a function of an overall mass of a sample container charged with samples and introduced into the sample container receptacle and the sample container receptacle and/or as a function of an overall mass of a sample container charged with samples and the mass of the rotary unit. This ensures accurate compensation of those masses that might cause an imbalance. As a result, centrifuge operation will be even smoother and safer.

It is considered rather advantageous if the sum of the one or plural damping mass(es) attached to the rotor is at a ratio of at least 0.5:1, in particular 1:1, relative to the overall mass which consists of the mass of the sample loads, the sample containers, the sample container receptacles, the rotary head receiving unit and the rotary unit. At these ratios, sufficient damping mass is provided for effectively counteracting imbalances that cannot be compensated completely by synchronizing the orientation of the sample containers, without overloading the centrifuge.

In another advantageous embodiment of the invention, the additional rotary mechanism is designed such that a first gear which is stationary with respect to the motor shaft and a second gear which is connected to the rotary head are provided, which motor shaft drives the rotor and, through the rotary movement of the rotor relative to the stationary first gear, also drives the second gear which is operatively connected to the first gear—which then causes the rotary head to be moved. This design of the rotary mechanism ensures that the individual rotary heads are driven in a particularly uniform manner, which results in equally uniform rotation of the individual sample containers.

In another embodiment of the invention it has proven advantageous to provide plural rotary units. If the transmission of the rotary movement from the first gear to a second gear each, and thus to the respective rotary head of the rotary unit, is of a design in which all the rotary heads of the rotary units have an identically shaped gear and therefore perform the same angular movement, this will ensure synchronous movement of all the rotary units.

In one aspect of the invention, the rotary heads and thus the rotary head receiving units with the sample receptacles and/or the sample containers have a zero position relative to the rotor, at which position intersection points are obtained of the radial line perpendicular to the axis of rotation of the rotary units through the zero position and a radially extending line perpendicular to the main axis of the rotor. This will only allow the sample containers to be introduced into the rotary head receiving unit in a single alignment with the rotary head receiving unit. All the intersection points lie on a circle around the main axis. This arrangement makes it easy to synchronize the rotary heads since it not only predetermines the actual rotary movement, but also the starting points of the rotary movement relative to each other.

All the rotary head receiving units and all the sample containers with samples directly or indirectly accommodated therein will preferably be identically oriented relative to the rotor at the zero positions of the rotary heads. In this case, in particular one lid each of the sample container is disposed radially outwardly relative to the rotor. This further enhances the synchronization of the rotary heads.

If the sum of the teeth of the engaging second gears of the rotary heads is an integral multiple of the number of teeth of the first gear, it will be easier to maintain constantly uniform angles between the rotary heads on the one hand and the rotor on the other.

Higher flexibility with regard to the ratio of the main speed of the dual centrifuge and the speed of the rotary units is achieved by connecting a transmitting gear between the first and second gears, with all of said transmitting gears being of identical design. Changing the respective transmitting gear is a convenient way of achieving a changed gear ratio.

To facilitate manual adjustment of the dual centrifuge regarding the positions of the rotary heads prior to starting operation of the centrifuge, it is advantageous to mark the zero position of the rotary head with an optical identifier. This will enable the user to recognize at first glance how the rotary heads will need to be oriented for a synchronous movement.

In another advantageous embodiment of the invention, each rotary head has a first bore at the zero position which bore extends through the second gear and will be aligned at the zero position with an associated second bore in a part which is stationary with respect to the rotor. At the zero position of the rotary unit, a pin can then be introduced into the first and second bores to lock the rotary unit at the zero position and prevent it from being rotated out of the zero position. This will align the rotary heads even more precisely than would be possible through a mere visual check. Furthermore, this will also prevent any unintentional rotation when the rotor is being mounted in the centrifuge. As a result, operational safety will be improved.

To facilitate the orientation of the rotary units even further and to make operation even safer, the pins associated with the bores can be interconnected via a clip in such a manner that the position of the pins will ensure that the weight distribution of two rotary units is aligned symmetrically relative to one another. This allows the alignment of all rotary heads to be secured in a single manual step.

In yet another advantageous embodiment the pin and/or the clip are provided with a blocking device which, in the mounted condition of the pin and/or the clip, will prevent closing of the centrifuge lid. This can be achieved by using especially long pins or a clip that opens particularly wide, for example. This will prevent the centrifuge from being started with the rotary heads still secured in their respective zero positions which would damage the device.

As an alternative, the bore and pin can also be arranged the other way round, i.e. with the pin on the rotary head and an associated bore in the clip.

The precision of the orientation of the rotary heads is considerably improved by the fact that the zero position has a maximum clearance of 2.5° in the direction of rotation.

In accordance with an embodiment of the invention, the rotary heads are coupled to each other via another rotary mechanism in such a manner that the rotary heads of different rotary units are always at a defined angular position relative to each other. This considerably reduces the risk of losing synchronization of the movement of the rotary heads during centrifuge operation.

Additional advantages, features and potential applications of the present invention may be gathered from the description which follows in combination with the embodiments illustrated in the drawings.

BRIEF DESCRIPTION OF THE DRAWINGS

Throughout the description, the claims and the drawings those terms and associated reference signs are used as are listed in the List of Reference Signs below. In the drawings.

DESCRIPTION OF THE INVENTION

Figure 1:
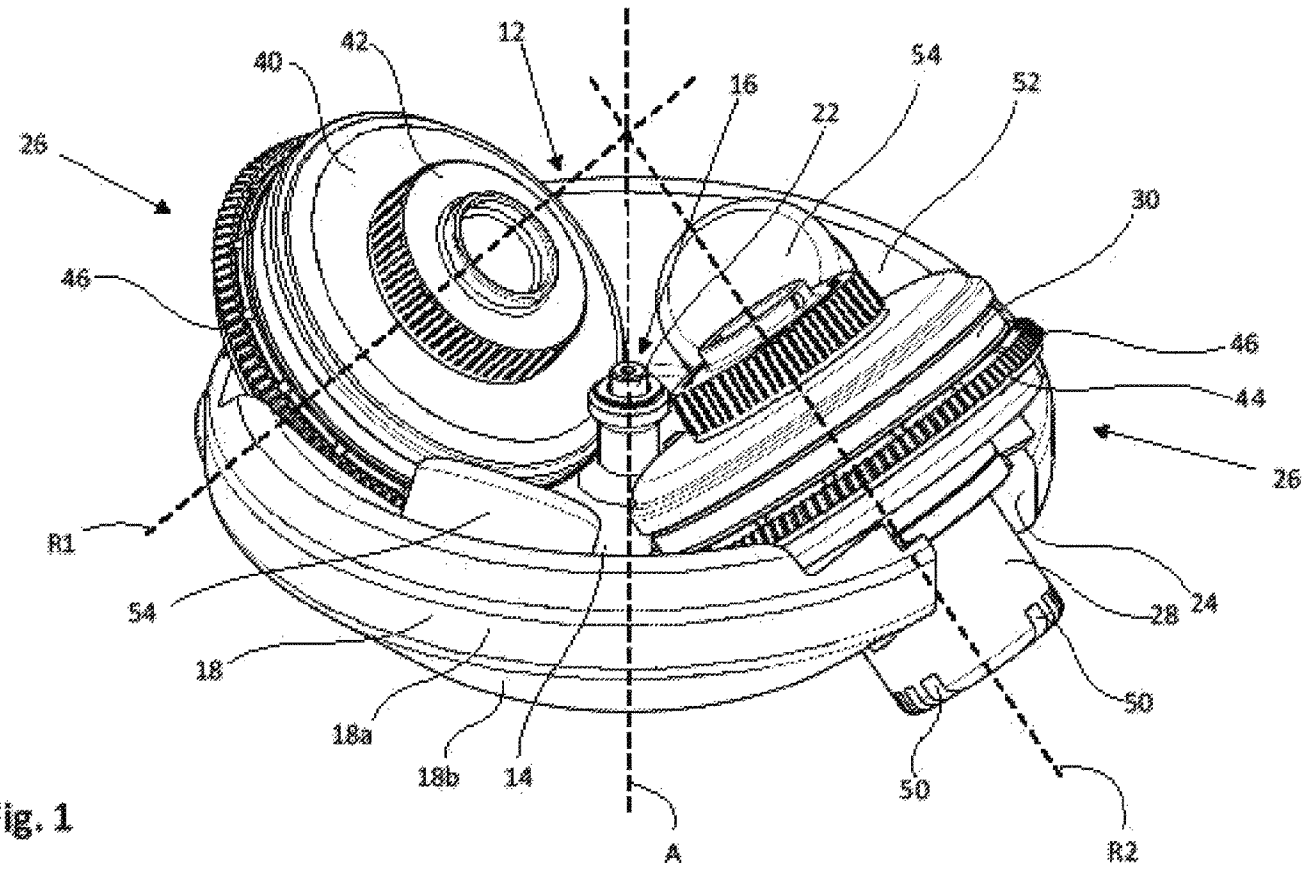
FIG. 1 is a perspective view of a rotor according to the invention.
Figure 2:
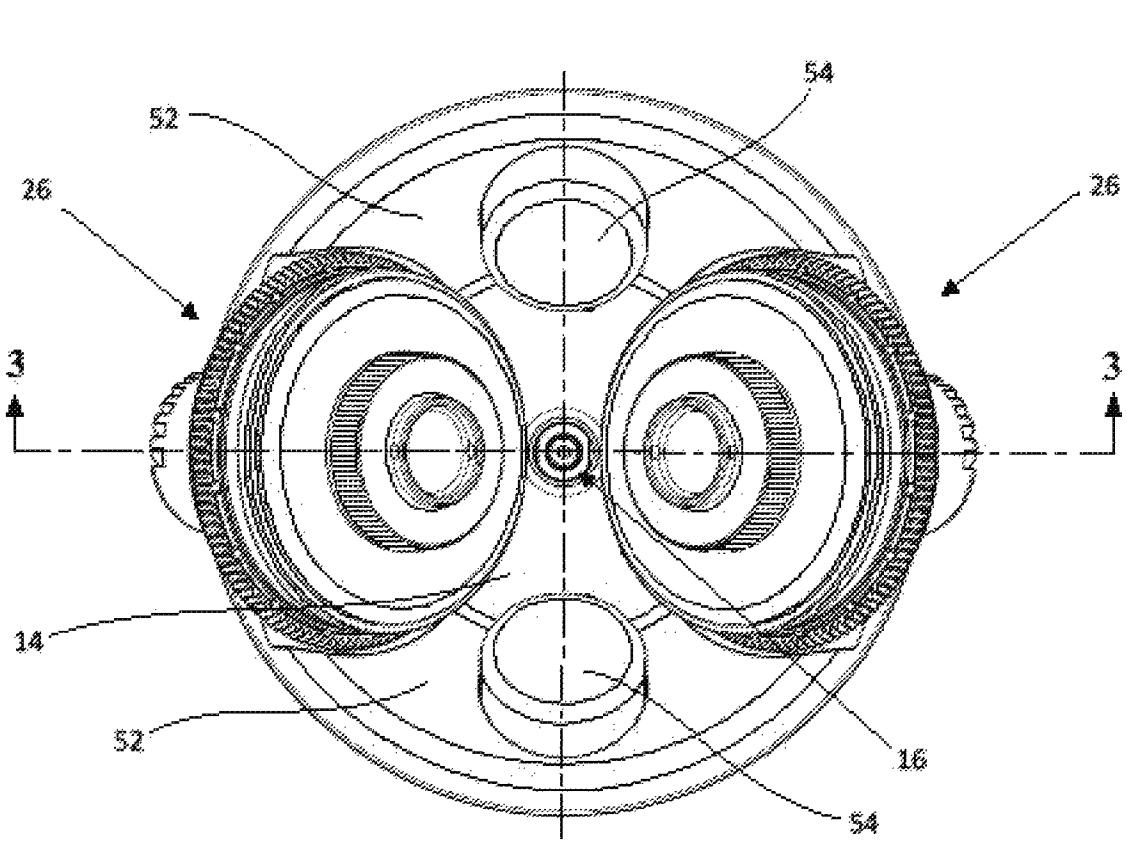
FIG. 2 is a top view of the rotor of FIG. 1.
Figure 3:
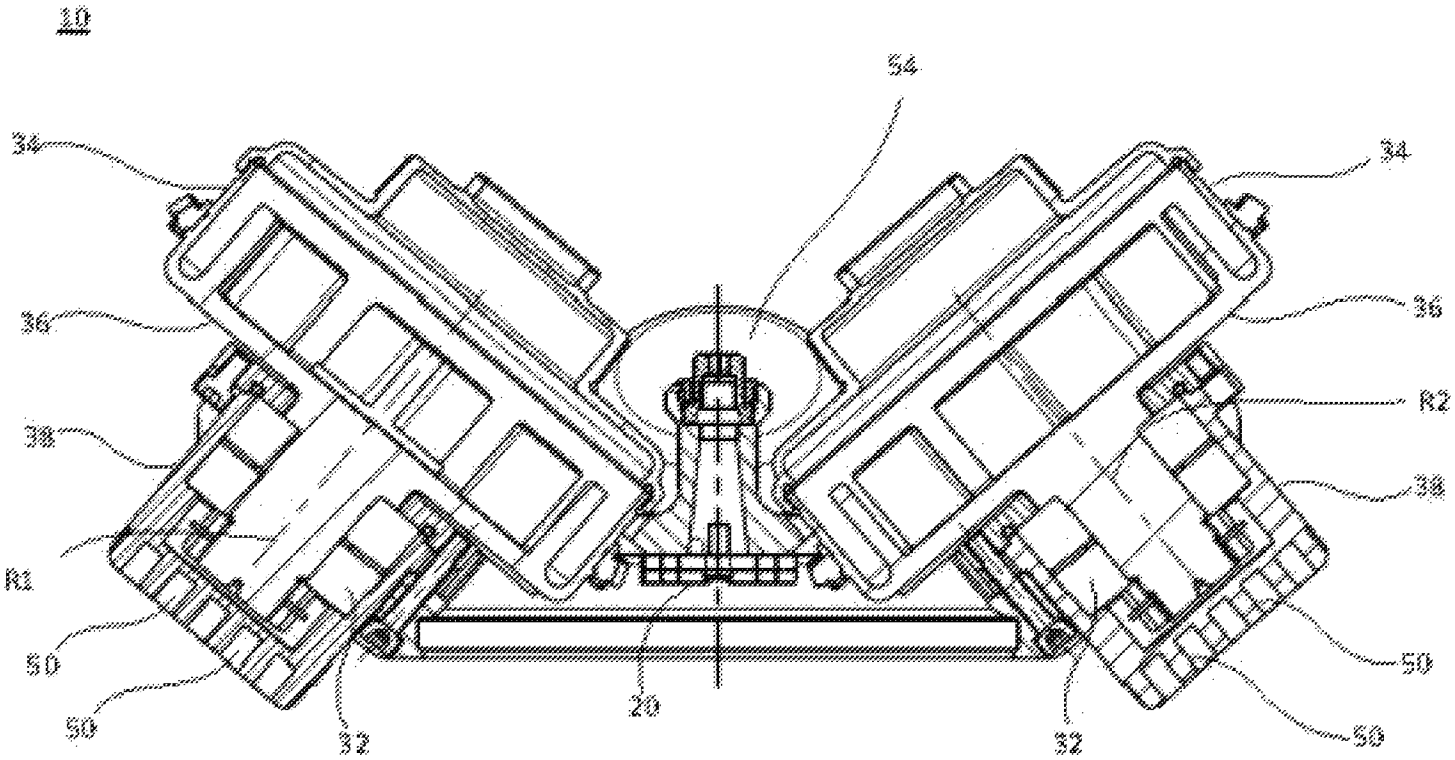
FIG. 3 is a lateral sectional view of the rotor of FIG. 1.

FIG. 1 is a perspective view of a rotor according to the invention 10 as part of a symmetric centrifuge with two rotary units 26 for use in a dual centrifuge not illustrated in the figures. FIG. 2 is a top view and FIG. 3 is a lateral sectional view, resp., of the rotor illustrated in FIG. 1.

The rotor 10 has a rotor head 12 of a rotationally symmetric basic shape which defines an envelope. The rotor head 12 is provided with a bottom 14 and a wall 18 that extends upwards and surrounds the bottom 14. A drive axis A extends perpendicular into the center 16 of the rotor head 12. A drive shaft not shown in the drawings has its free end extending through the rotor head 12 via an aperture 20 in the bottom 14, which aperture 20 is concentric with the drive axis A. Above the aperture 20, a receiving tube 22 is integrally formed with the bottom 14, which tube 22 serves to center and vertically fix the rotor head 12 in position on the drive shaft.

The wall 18 has a vertical portion 18*a* and a portion 18*b* that inclines downwards in the direction of the drive axis. Two apertures 24 are provided that are disposed opposite each other relative to the drive axis A, which apertures 24 partially extend through the vertical portion 18*a* of the wall 18 and the inclined portion 18*b* of the wall 18.

The rotary units 26 each have an axis of rotation R1, R2 and are oriented by way of the apertures 24 in such a way that the axes of rotation R1 and R2 intersect the drive axis A at an acute angle above the rotor 10. Furthermore, the free ends of the rotary units 26 facing away from the drive axis A, i.e. the housings 28 described in the following, see FIG. 4, protrude from the envelope in the area of the inclined portion 18*b* of the wall 18.

Each rotary unit 26 has a largely rotationally symmetric outer contour and comprises a rotatably mounted rotary head 30, see FIG. 3, for supporting a rotary head receiving unit 80 with a sample container receptacle 100, 110 inserted therein, which latter contains sample containers for samples to be centrifuged, and a housing 28 with a bearing 32 for the rotary head 30, which bearing 32 is in turn engaged by a bearing shaft of the rotary head 30, which bearing shaft (not shown for reasons of clarity) is disposed on the side of the rotary head 30 which faces the housing 28.

The rotary head 30 has an outer wall 34 which is mounted concentrically with the rotational axis R1, R2. The housing 28 is provided with a wall 38 that is concentric with the rotational axis R1, R2. The diameter of the rotary head 30 is larger than that of the housing 28 which results in the formation of a shoulder 36 between the outer wall 34 of the rotary head 30 and the wall 38 of the housing 28, with the rotary unit 26 partially engaging in the associated aperture 24 via this shoulder 36, see FIG. 1.

The dimensions of the housing 28 have been adapted to the respective associated areas of the apertures 24. For ensuring that the housing 28 and the rotor head 12 are non-rotatably mounted, a groove is provided in the housing 28 parallel to the axis of rotation R1, R2 and a projection associated with said groove is provided on the rotary head 12. Both the groove and the projection have been omitted from the drawings for reasons of clarity. Moreover, the groove and the projection can also be disposed the other way round. Furthermore, it is also possible to choose a polygonal design for the housing 28 instead of a cylindrical shape so as to mount a housing in a rotary head in a non-rotatable manner.

As seen in FIG. 1, the side of the rotary head 30 which is remote from the housing 28 is furthermore closed by a closure lid 40 which is disposed concentrically with the rotational axes R1, R2. Equally concentrically mounted on the closure lid 40 is a closure knob 42 which serves as a handle for unlocking the closure lid 40 by means of a rotary movement and taking it off or for putting the closure lid 40 on the rotary head 30 and locking it in place by means of a rotary movement in a direction opposite to the locking direction.

Figure 4:
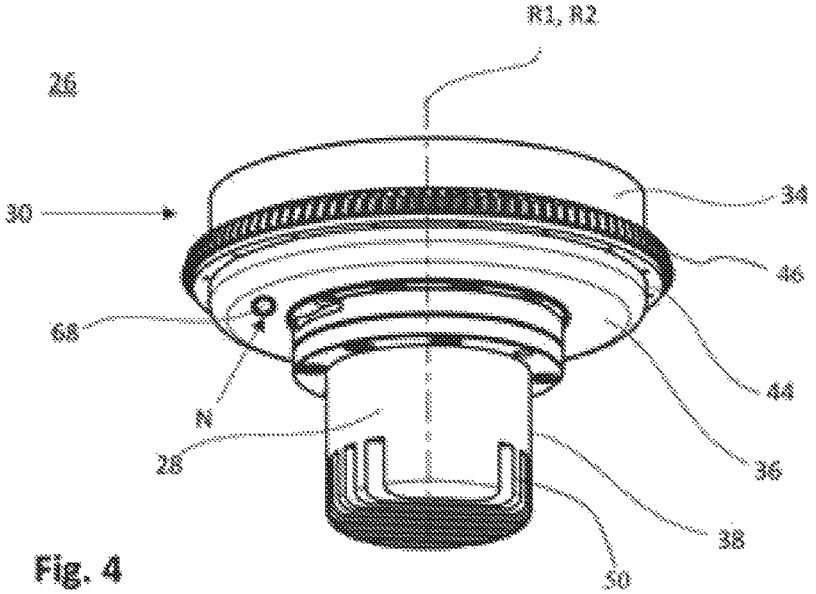
FIG. 4 is a perspective bottom view of an embodiment according to the invention of a rotary unit.

A circumferential projection 44 is provided on the outer wall 34 adjacent to the shoulder 36, as seen e.g. in FIG. 4, which projection 44 fixes a gearing 46 concentrically relative to the axes of rotation R1, R2, which gearing 46 is non-rotatably connected to the outer wall 34. For transmitting the rotary movement of the rotary heads 30 about the axes of rotation R1, R2 of the rotary units 26, a central gear (omitted from the figures for reasons of clarity) is provided below the rotor head 12, which central gear is non-rotatably connected to the rotatable rotor head 12, e.g. by means of a screwed connection to a motor housing (not shown in the figures). A transmitting gear can be provided between said gearing 46 and said central gear so as to achieve different gear ratios. The transmission of rotary movements in such a manner is well known and has already been described in the prior art, for which reason no further explanations are necessary here.

The ratio of the main rotation (rotation of the rotor 10) to the reverse rotation (rotation of the rotary head 30) is defined by the gear ratio between the gear 46 and the central gear (not shown) and, if necessary, an additional transmitting gear. Once the rotor head 12 has been removed, the transmitting gear (not shown) and the central gear can be easily exchanged. This allows the speed ratio to be changed in a simple manner by adapting the respective diameters of the gear (not shown) and the central gear.

On the side of the housing 28 which is remote from the rotary head 30, cooling ribs 50 are provided. The cooling ribs 50 are aligned perpendicular to the direction of rotation of the rotor head 12.

The side of the wall 18 which faces the center 16 of the rotor head 12 is formed as a connection region 52 on which two disk-shaped damping masses 54 are disposed opposite each other relative to the center 16 of the rotor head 12. The damping masses 54 are provided to reduce the adverse effects of imbalances which may occur during operation, in particular in the rotary units 26.

FIG. 4 is a perspective bottom view of the rotary unit 26 illustrated in FIGS. 1 through 3 with the closure lid 40 removed. This view clearly shows the arrangement in particular of the projection 44 and the gearing 46 on the outer wall of the rotary head 30 as well as of the cooling ribs 50 on the side of the housing 28 which faces away from the rotary head 30.

Figure 5:
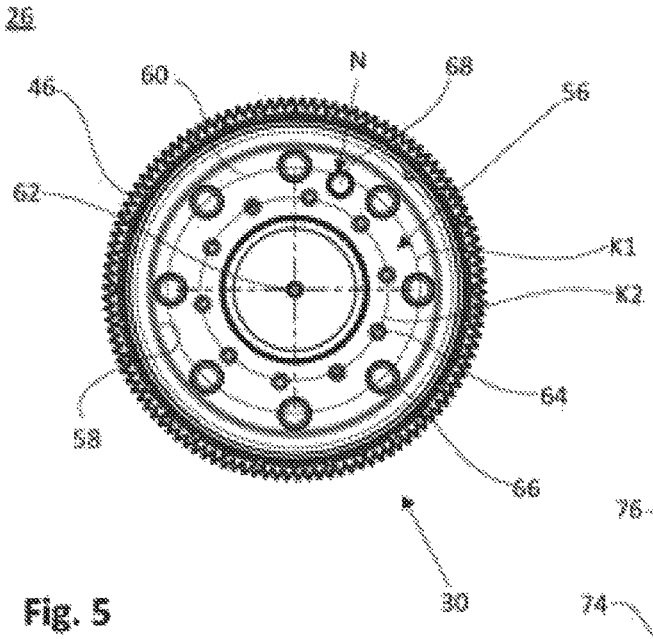
FIG. 5 is a top view of the rotary unit illustrated in FIG. 4.

FIG. 5 is a top view of the rotary unit 26 illustrated in FIG. 4. A bottom 60 which has a circular area and a center 62, and an inner wall 58 provided on the periphery of said bottom 60 and extending concentrically with the outer wall 34 of the rotary head 30 delimit a receiving area 56 which is open towards the top and adapted to receive a rotary head receiving unit 80 described below with reference to FIG. 7.

In the bottom 60, ten uniformly spaced bores are provided on a circular line K2 extending around the center 62 for reasons of clarity, which bores are used for riveting the rotary head 30 to the housing 28 to form a structural unit.

Figure 7:
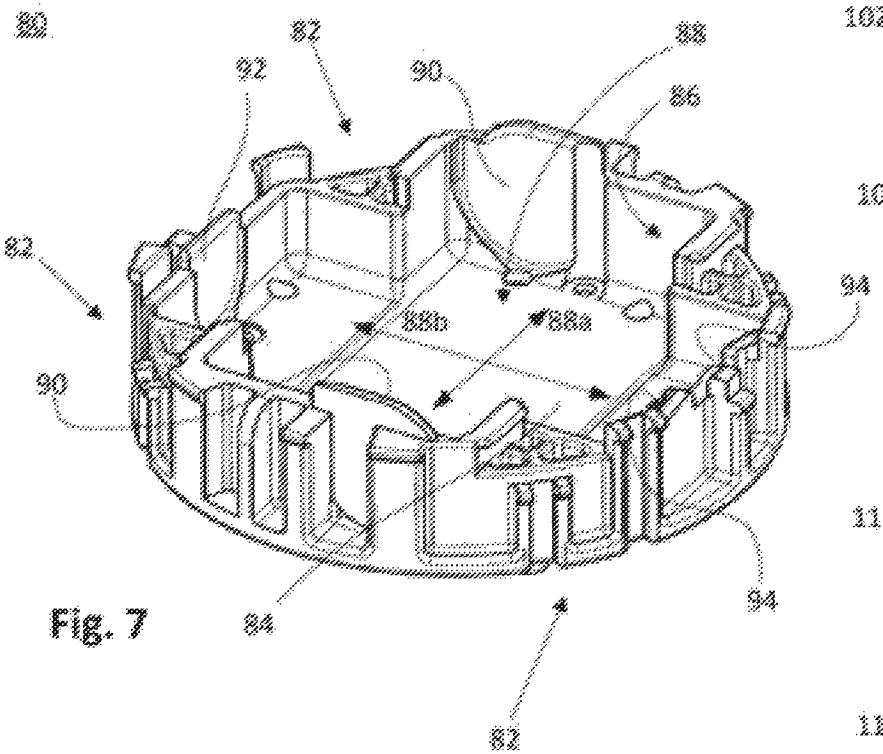
FIG. 7 a perspective view of an embodiment according to the invention of a rotary head receiving unit.

On another circular line K2 which likewise extends around the center 62, eight uniformly spaced recesses 66 are provided. When the rotary head receiving unit 80 as exemplarily illustrated in FIG. 7 is inserted, the recesses 66 serve to accommodate wedges, pins or the like provided on the rotary head receiving unit 80 as guiding means and for improving the safety of the connection. A lateral guide (not shown) for which an associated counter-guide is provided on the outer wall ensures that the rotary head receiving unit 80 can be mounted in the rotary unit in a single orientation only.

Figure 4A:
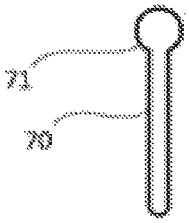
FIG. 4*a* is a view of the pin according to the invention.

Furthermore, adjacent to the inner wall 58, a bore 68 is provided in the bottom 60. As can also be seen in FIG. 4, this bore 68 extends completely through the bottom 60 and serves to accommodate a pin 70 as shown in FIG. 4*a*. At the same time, the bore 68 indicates a zero position N of the rotary unit 26 which can be used to align the rotary unit 26 in such a way that it moves in synchronization with other rotary units 26 disposed in the rotor head 12. Diametrically opposite said bore 68 another bore may be provided for the sake of symmetry, thus compensating for any imbalance caused by the bore 68.

At the end of the pin 70 there is a ball-shaped grip 71 and the length of the pin is dimensioned such that it extends through the bore 68 and that its free end will engage in a bore provided in the rotor head 12, which latter bore has been omitted from the drawings for reasons of clarity. This fixes the rotary unit 26 at the zero position N. Moreover, the pin can be dimensioned such that it will prevent closing of a centrifuge lid.

Figure 6:
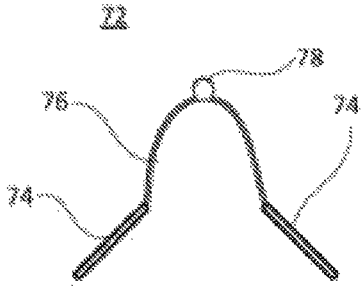
FIG. 6 is a view of a clip according to the invention.

FIG. 6 shows a clip 72 which can be used to fix two rotary units 26 at their respective zero position N at the same time. A pin 74 each is provided on either free end of the clip 72. The two pins 74 are of the same length as the pin 70 and are spaced from each other via a resiliently elastic connecting clip 76 and are arranged at an angle from each other such that they can be introduced simultaneously into two bores 68 of two rotary heads 30. The resiliently elastic design of the connecting clip 76 allows minor changes of the distance and the setting angle as may be required for insertion and removal of the pins 74.

At the center of the connecting clip 76 a ball-shaped grip 78 is provided. This grip 78 first of all facilitates handling of the clip 72 and secondly, in the inserted condition of the clip 72, the grip 78 will be positioned so as to prevent complete closure of a centrifuge lid.

Figure 8A:
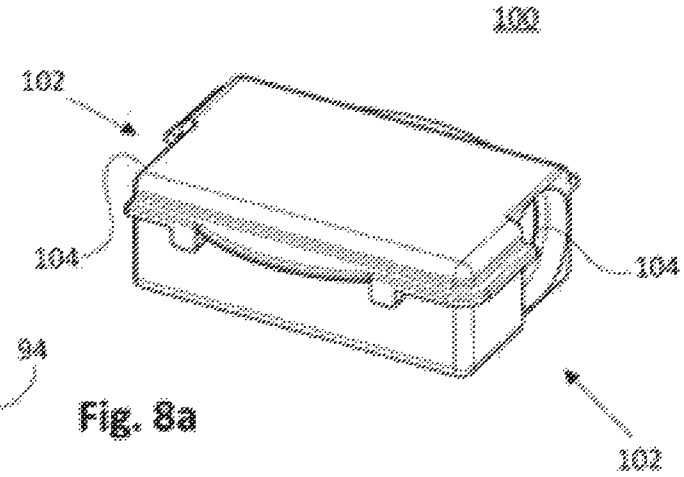
FIG. 8*a* a perspective view of an embodiment according to the invention of a sample container receptacle which can be disposed in the rotary head receiving unit illustrated in FIG. 7, and FIG. 8*b* a perspective view of another embodiment according to the invention of a sample container receptacle which can be disposed in the rotary head receiving unit illustrated in FIG. 7.
Figure 8B:
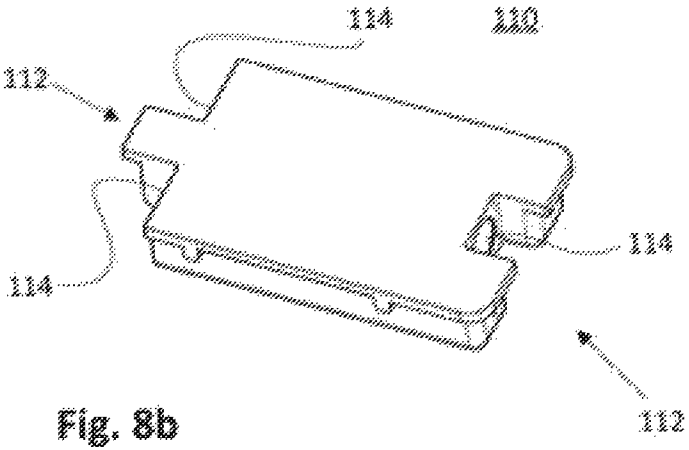

FIG. 7 is a view of an embodiment of a rotary head receiving unit 80 which can be mounted in the receiving area 56 of the rotary head 30 so as to support the sample container receptacles 100 and 110 exemplarily shown in FIGS. 8*a* and 8*b* safely therein. The outer circumference of the rotary head receiving unit 80 has been adapted to the receiving area 56.

The rotary head receiving unit 80 has a safety wall 82 and a bottom 84. An inner contour 86 of the safety wall 82 and the bottom 84 delimit a cross-shaped receiving space 88 which is open towards the top. Two rectangular legs 88*a* and 88*b* of the receiving space 88 are disposed perpendicular to each other, with the base area each of the first leg 86*a* and of the second leg 86*b* being identical and corresponding to the base area of the sample container receptacles 100, 110 illustrated in FIGS. 8*a* and 8*b*, resp.

The first leg 88*a* serves to accommodate the sample container receptacle 100. For this purpose, a recess 90 is provided in the safety wall 82 at either end of the leg 88*a*, which two recesses 90 are arranged diametrically to one another relative to the leg 88*a*. The recesses 90 serve to reliably clamp the sample container receptacle 100 with the centrifuge tubes inserted therein in the rotary head receiving unit 80, as will be explained in more detail with reference to FIG. 8*a*.

The second leg 88*b* serves to receive the sample container receptacle 110. For this purpose, one recess 92 is provided in the safety wall 82 at one end of the leg 88*b* and two recesses 94 are provided in the safety wall 82 at the second end of the leg 88*b*. The recesses 92, 94 are used to safely clamp the sample container receptacle 110 in the rotary head receiving unit 80, as will be explained in more detail with reference to FIG. 8*b*.

FIG. 8*a* is a view of a first sample container receptacle 100 according to the invention, which, as described with reference to FIG. 7, is adapted to be received in the first leg 88*a* of the rotary head receiving unit 80.

The sample container receiving area 100 has an aperture 104 each in two front faces 102, which aperture 104 will accommodate and vertically support therein a centrifuge tube as a sample container, which centrifuge tube has been omitted from the drawing for reasons of clarity. On either front face 102 an end of a centrifuge tube (lid side) protruding from the respective aperture 104 engages in an associated recess 90 in the safety wall 82. This clamps the sample container receptacle 100 in position in the rotary head receiving unit 80.

FIG. 8*b* is a view of a second sample container receptacle 110 which is adapted to be received in the second leg 88*b* of the rotary head receiving unit 80.

In FIG. 8*b*, on its front face 112 facing the observer, the sample container receptacle 110 has an aperture 114, and on its front face 112 facing away from the observer, it has two apertures 114. These apertures 114 can be used to receive and vertically support centrifuge tubes therein, which tubes have been omitted from this figure for reasons of clarity. Similar to the solution illustrated in FIG. 8*a*, here, too, the ends of a centrifuge tube which protrude from the respective aperture 114 on either front face 112 engage in an associated recess 92, 94 in the safety wall 82. This clamps the sample container receptacle 110 in position in the rotary head receiving unit 80.

The rotary head receiving unit 80 and the sample container receptacles 100 and 110 were chosen as an example, since arranging elongated sample container receptacles with sample containers perpendicular to the axis of rotation R1, R2 of the rotary unit 26 entails a high risk of causing imbalances, for which reason attaching a damping mass is considered particularly advantageous. However, there are numerous other examples of how sample container receptacles for sample containers can be mounted in a different manner, also mounting the sample container directly in the rotary head receiving unit.

LIST OF REFERENCE SIGNS

10 rotor
12 rotor head
14 bottom
16 center
18 wall
18*a* vertical portion
18*b* inclined portion
20 aperture
22 receiving tube
24 aperture
26 rotary unit
28 housing
30 rotary head
32 bearing
34 outer wall
36 shoulder
38 wall
40 closure lid
42 closure knob
44 projection
46 gearing
50 cooling ribs
52 connection region
54 damping masses
56 receiving area
58 inner wall
60 bottom
62 center
64 bores
66 recesses
68 bore
70 pin
71 grip
72 clip
74 pins
76 connecting clip
78 grip
80 rotary head receiving unit
82 safety wall
84 bottom
86 inner contour
88 receiving space
88*a* first leg
88*b* second leg
90 recess
92 recess
94 recess
100 sample container receptacle
102 front face
104 aperture
110 sample container receptacle
112 front face
114 aperture
A drive axis
R1, R2 axes of rotation
K1 circular line
K2 circular line
N zero position

The invention claimed is:

1. Dual centrifuge rotor (10), comprising:
a drive axis (A);
said rotor (10) is rotated about said drive axis (A) in a centrifuge;
said rotor (10) comprises at least two rotary units (26) that are arranged symmetrically to one another;
each of said rotary units has a rotary head (30);
said rotary head is mounted in a bearing (32) so as to be rotatable about an axis of rotation (R1, R2);
said rotary head (30) includes an opening (56) therein;
said rotary head (30) is driven about said axis of rotation (R1, R2) relative to said rotor by another rotary mechanism (46) of said centrifuge;
a rotary head receiving unit (80) for at least one sample container or at least one sample container receptacle (100, 110);
said axis of rotation (R1, R2) of said rotary head (30) being aligned so as to be inclined relative to said drive axis (A) of said rotor;
said rotary head receiving unit (80) receives an elongated sample container receptacle (100, 110) or an elongated sample container;
said rotary head receiving unit (80) is mounted in said opening (56) of said rotary head (30);
at least one damping mass;
a longitudinal axis of said sample container receptacle (100, 110) inserted into said rotary head receiving unit (80) or said longitudinal axis of said sample container inserted into said rotary head receiving unit (80) being oriented perpendicular to said axis of rotation (R1, R2) of said rotary head (30) or at an angle ranging between more than 0° and less than 90° relative to said axis of rotation;

at least one connection region (52) on said rotor defined between said rotary units and, said at least one damping mass (54) is selectively attached either in a releasable manner or in a permanent manner to said at least one connection region for operation.

2. Rotor according to claim 1, further comprising: plural mass elements (54) in said at least one connection region (54).

3. Rotor according to claim 1, further comprising:

said at least one damping mass comprises a single damping mass (54) of a predetermined weight or plural equal or unequal damping masses (54) of predetermined weights.

4. Rotor according to claim 1, further comprising:

plural damping masses (54) are mounted in plural connection regions (52).

5. Rotor according to claim 1, further comprising:

said at least one sample container receptacle (100, 110) or one sample container is arranged in said rotary head receiving unit (80), and that said damping mass or masses (54) is/are determined as a function of a total mass consisting of said sample container loaded with samples introduced into a sample container receptacle (100, 110) and a sample container receptacle, and/or as a function of a total mass consisting of said sample container loaded with samples and the mass of the rotary unit (26).

6. Rotor according to claim 1, further comprising:

said another rotary mechanism (46) includes a first gear stationary relative to the motor shaft and a second gear which is connected to said rotary head (30), said motor shaft driving said rotor and driving said second gear through said rotary movement of said rotor relative to said stationary first gear, and, said second gear is operatively connected to said first gear.

7. Rotor according to claim 6, further comprising:

transmission of said rotary movement from said first gear to a second gear and thus to said rotary head (30) of said rotary unit (26) such that all of said rotary heads (30) of said rotary units (26) have a gear with identically shaped teeth and thus perform the same angular movement.

8. Rotor according to one of claim 6, further comprising:

said rotary heads (30) and therefore said rotary head receiving units (80) have a zero position (N) relative to said rotor; and, intersection points of the radial line perpendicular to said axis of rotation (R1, R2) of said rotary heads (30) through the zero position (N) are formed with a radially extending line perpendicular to said drive axis (A) of said rotor and all said intersection points lie on a circle which extends around said drive axis (A).

9. Rotor according to claim 8, further comprising:

said rotary head receiving units (80) and said sample containers directly or indirectly introduced therein are all identically oriented relative to said rotor at said zero positions (N) of said rotary heads (30), and, a lid of each of said sample container is disposed radially outwardly relative to said rotor.

10. Rotor according to claim 8, further comprising:

the zero position (N) of said rotary heads (30) is optically marked.

11. Rotor according to claim 8, further comprising:

a first bore (68) in said rotary heads (30) at the zero position (N) in said rotary heads;

said bore extends through said second gear and, at said zero position (N), is aligned with an associated second bore in said rotor heads; and, a pin (70, 74) at said zero position (N) of said rotary units (26) introduced into said first bore (68) and said second bore, thus securing said rotary units (26) at said zero position (N) against being rotated out of said zero position (N).

12. Rotor according to claim 11, further comprising:

a connecting clip (76) interconnects said pins (74) associated with said bores (68) to form a clip (72);

positions of said pins (74) relative to one another correspond to the positions of said bores (68) assume relative to one another when said rotary heads (30) are at the zero positions (N).

13. Rotor according to claim 11, further comprising:

said pin (70) and/or the clip (72) includes a grip (78), said grip prevents the centrifuge lid from being closed once said pin (70) or said clip (72) has been inserted.

14. Rotor according to claim 8, further comprising:

the zero position has a maximum clearance of 2.5° in the direction of rotation.

15. Rotor according to claim 6, further comprising:

the sum of the teeth of the engaging second gears of said rotary heads (30) is an integer multiple of the number of teeth of said first gear.

16. Rotor according to claim 6, further comprising:

a transmitting gear is connected between said first gear and said second gear, said transmitting gears being of identical shape.

17. Rotor according to claim 1, further comprising:

said rotary heads (30) are coupled to each other via another rotary mechanism (46) such that said rotary heads (30) of different rotary units (26) are always at a fixed position relative to one another.

18. Rotor according to claim 1, further comprising:

said rotary head receiving unit includes a first (90) and second (90) recess therein;

said elongated sample container receptacle (100, 110) is clamped in said recesses of said rotary head receiving unit.

19. Rotor according to claim 18, further comprising:

said rotary head receiving unit includes a third (92) and fourth (92) recess therein;

a second elongated sample container receptacle (100, 110) is clamped in said recesses (92, 92) of said rotary head receiving unit.

20. Dual centrifuge rotor (10), comprising:

a drive axis (A);

said rotor (10) is rotated about said drive axis (A) in a centrifuge;

said rotor (10) comprises two rotary units (26) that are arranged symmetrically to one another each of said rotary units has a rotary head (30);

said rotary head is mounted in said bearing (32) so as to be rotatable about an axis of rotation (R1, R2);

said rotary head (30) includes an opening (56) therein:

said rotary head (30) is driven about said axis of rotation (R1, R2) relative to said rotor by another rotary mechanism (46) of said centrifuge;

a rotary head receiving unit (80) for at least one sample container or at least one sample container receptacle (100, 110);

said axis of rotation (R1, R2) of said rotary head (30) being aligned so as to be inclined relative to said drive axis (A) of said rotor;

said rotary head receiving unit (80) receives an elongated sample container receptacle (100, 110) or an elongated sample container;

said rotary head receiving unit (80) is mounted in said opening (56) of said rotary head (30);

at least one damping mass;

a longitudinal axis of said sample container receptacle (100, 110) inserted into said rotary head receiving unit (80) or said longitudinal axis of said sample container inserted into said rotary head receiving unit (80) being oriented perpendicular to said axis of rotation (RI, R2) of said rotary head (30) or at an angle ranging between more than 0° and less than 90° relative to said axis of rotation;

at least one connection region (52) on said rotor defined between said rotary units and, said two rotary units (26) are identical, said rotary units (26) are identically oriented relative to said axis of drive axis of rotation (A) at a zero position (N), with each said rotary head receiving unit (80) being identically arranged and oriented in said rotary unit (26), said rotary units (26) move in synchronization with said rotary head receiving units (80), said sample container receptacles (100, 110) and/or said sample containers; and, said at least one damping mass (54) is selectively attached either in a releasable manner or in a permanent manner to said at least one connection region.

* * * * *